US007878379B2

(12) United States Patent
Murphy, Jr.

(10) Patent No.: US 7,878,379 B2
(45) Date of Patent: Feb. 1, 2011

(54) CLOTHING HANGER

(76) Inventor: H. Stetser Murphy, Jr., 1525 G Terrell Mill Pl., Marietta, GA (US) 30067

( * ) Notice: Subject to any disclaimer, the term of this patent is extended or adjusted under 35 U.S.C. 154(b) by 639 days.

(21) Appl. No.: 10/776,848

(22) Filed: Feb. 11, 2004

(65) Prior Publication Data

US 2005/0173475 A1 Aug. 11, 2005

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS 2,946,493 A * 7/1960 Bury et al. ..... 223/92
3,148,808 A * 9/1964 Griffin et al. ..... 223/86
4,169,549 A 10/1979 Takagi
4,586,637 A 5/1986 Lemel
4,606,482 A 8/1986 McHugh
4,730,737 A * 3/1988 Robinson ..... 211/113
4,817,791 A 4/1989 Adams
4,872,568 A * 10/1989 Lehmann ..... 211/113
5,022,570 A 6/1991 Watford
5,333,743 A 8/1994 Loewke et al.
5,344,054 A 9/1994 Nutter
5,405,065 A 4/1995 Olson
5,503,311 A 4/1996 Chen
5,577,644 A * 11/1996 Chen ..... 223/85
5,598,956 A 2/1997 Schenberg
5,836,487 A 11/1998 Lam
5,876,009 A 3/1999 Simoncioni, Jr.
6,068,166 A 5/2000 Kilian et al.
6,073,819 A 6/2000 Wing
6,170,721 B1 * 1/2001 Chen ..... 223/85
6,176,400 B1 1/2001 Lam
6,196,074 B1 3/2001 Varhol
6,196,398 B1 3/2001 Lowe
6,328,186 B1 12/2001 Wing
2006/0113334 A1 * 6/2006 Mikhail et al. ..... 223/85

* cited by examiner

*Primary Examiner*—Shaun R Hurley
(74) *Attorney, Agent, or Firm*—Woodcock Washburn LLP

(57) ABSTRACT

A clothes hanging device in the form of an arcuate hook with a ball at one end thereof. The ball is sufficient in diameter and texture such that clothing draped upon it will remain in place and will not be deformed in shape.

19 Claims, 4 Drawing Sheets

CLOTHING HANGER

TECHNICAL FIELD

The present invention relates generally to garment hangers and more specifically to an apparatus and method for hanging clothing, wherein clothing hung thereby experiences minimal structural deformation. The present invention is particularly suited to suspending knit garments, such as, for exemplary purposes only, golf shirts, blouses, T-shirts, sweatshirts, and like clothing that is particularly susceptible to deformation.

BACKGROUND OF THE INVENTION

Various devices and methods are available for hanging clothing and the like, such as conventional wire hangers and ball-end hangers. Unfortunately, most available clothing hangers are functionally and structurally disadvantageous for knit clothing. For instance, existing ball-ends are small, smooth, and typically distort knit clothing, which easily slips off. Additionally, common wire hangers can cause deformation of knit clothing and are thus disadvantageous.

Therefore, it is readily apparent that there is a need for a hanger apparatus and method that overcomes the aforementioned disadvantages by providing a hanger that securely retains knit clothing from falling and minimizes or prevents deformation of the clothing hung thereon.

BRIEF SUMMARY OF THE INVENTION

Briefly described, in a preferred embodiment, the present invention overcomes the aforementioned disadvantages and meets the recognized need for such a device by providing a method and apparatus for hanging knit clothing that preferably does not deform the clothing hung thereon. The present apparatus and method is particularly suitable for hanging knit clothing, which is susceptible to deformation while in the hanging state.

According to its major aspects and broadly stated, the present invention in its preferred embodiment is a hanger in the configuration of an 'S'-shaped hook, wherein one end of the hanger has a ball-shaped structure in communication therewith, wherein the ball-shaped structure securely retains clothing placed thereon without deforming the clothing so placed, and wherein retention of clothing thereon is facilitated via use of a non-slip surface.

More specifically, the present invention in its preferred form is an apparatus and method for hanging knit clothing, having a hook possessing a first curved end for hanging over or engaging a horizontal pole or rod, and a second end, wherein the second end is ball-shaped and of sufficient surface area to prevent deformation of clothing hung thereon. The ball-shaped end further includes a non-slip surface of sufficient friction to facilitate retention of the clothing placed thereon.

A feature and advantage of the present invention is its ease of use.

A feature and advantage of the present invention is that it can retain knit clothing in a hanging position without causing deformation of the clothing.

A feature and advantage of the present invention is its ease of manufacture.

A feature and advantage of the present invention is its suitability for hanging various types of clothing.

A feature and advantage of the present invention is its one-piece construction.

A feature and advantage of the present invention is that it can be manufactured as, and assembled from, individual components.

A feature and advantage of the present invention is that it can be fabricated in a configuration having multiple hook and ball ends.

A further feature and advantage of the present invention is its suitability for hanging draping material.

An additional feature and advantage of the present invention is that it can be manufactured in different colors and/or different sizes.

These and other features and advantages of the present invention will become more apparent to one skilled in the art from the following description and claims when read in light of the accompanying drawings.

BRIEF DESCRIPTION OF THE DRAWINGS

Figure 1A:
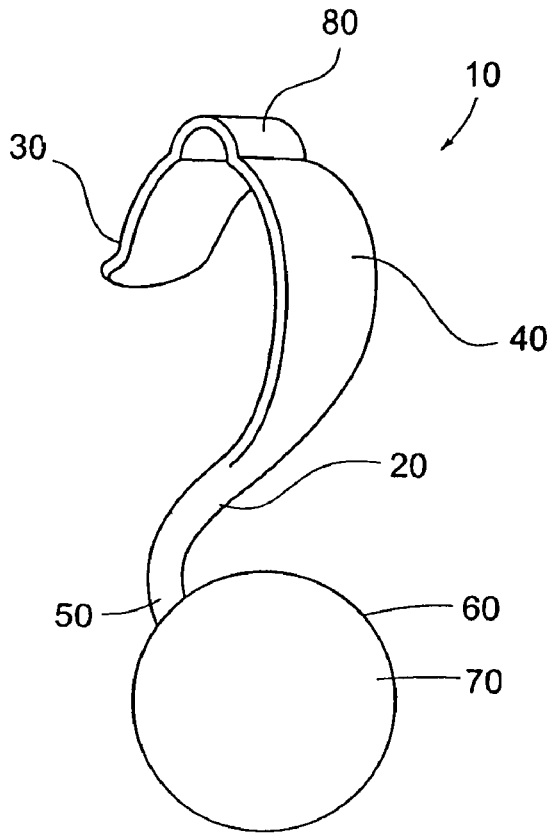
Figure 1B:
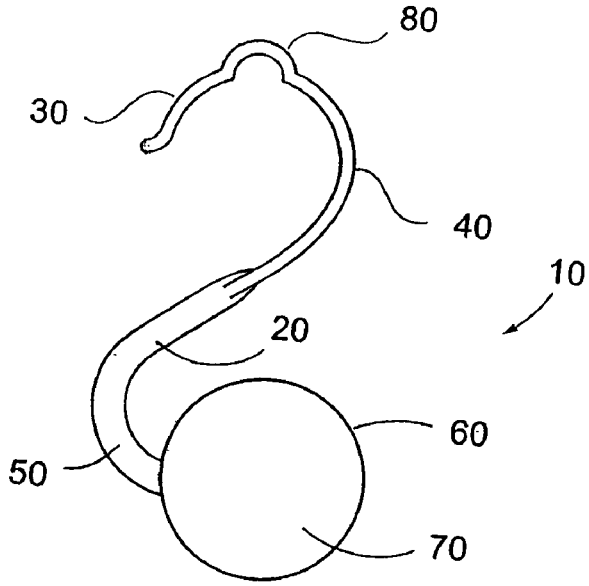
Figure 2:
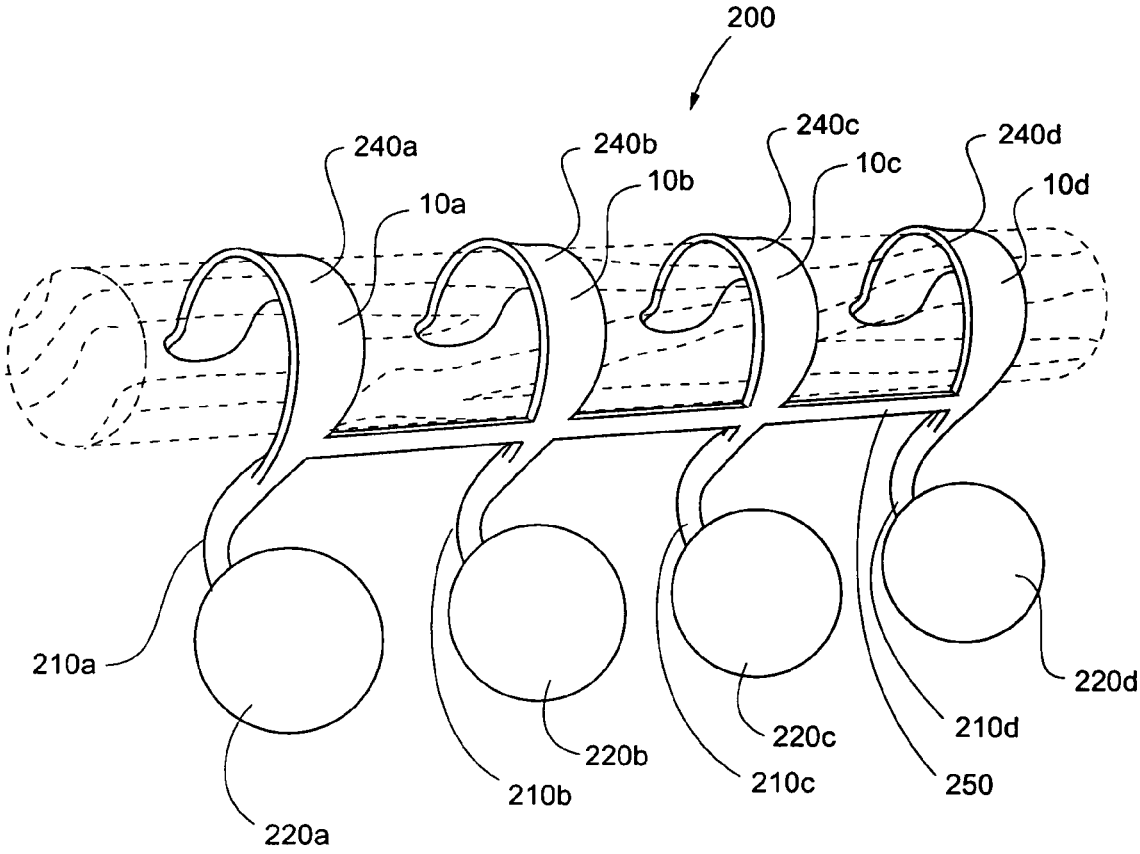
Figure 3A:
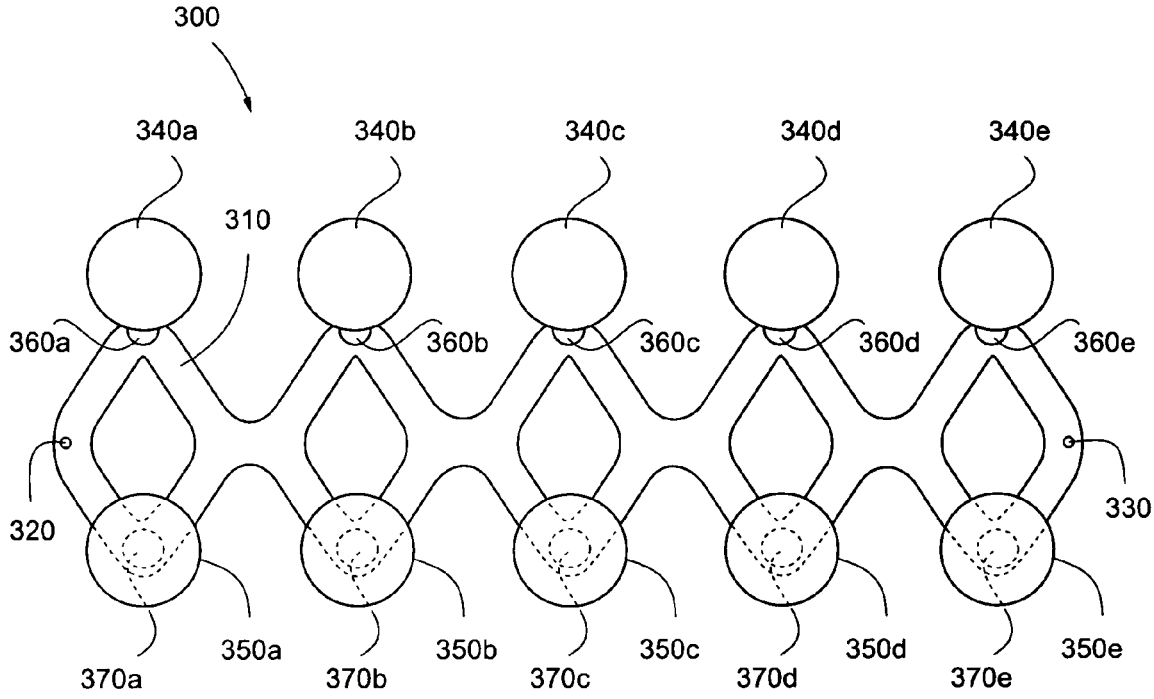
Figure 3B:
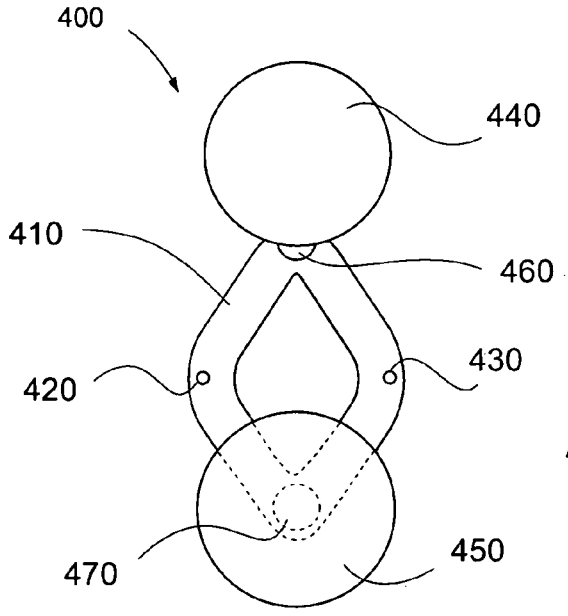
Figure 3C:
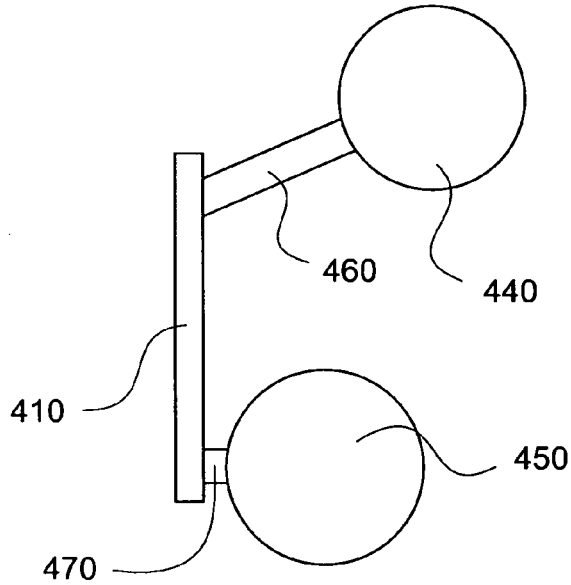

Having thus described the invention in general terms, the present invention will be better understood by reading the Detailed Description of the Preferred and Selected Alternate Embodiments with reference to the accompanying drawing figures, which are not necessarily drawn to scale, and in which like reference numerals denote similar structures and refer to like elements throughout, and in which:

FIG. 1A is a perspective view of a clothing hanger according to a preferred embodiment of the present invention;

FIG. 1B is a side view of a clothing hanger according to a preferred embodiment of the present invention;

FIG. 2 is a perspective view of a clothing hanger according to an alternate embodiment of the present invention;

FIG. 3A is a front view of a clothing hanger according to an alternate embodiment of the present invention having multiple two-ball units;

FIG. 3B is a front view of a clothing hanger according to an alternate embodiment of the present invention having a single two-ball unit; and FIG. 3C is a profile view according to the alternate embodiment shown in FIG. 3B, as well as depicting the upper and lower ball profile according to the alternate embodiment of FIG. 3A.

Figure 4A:
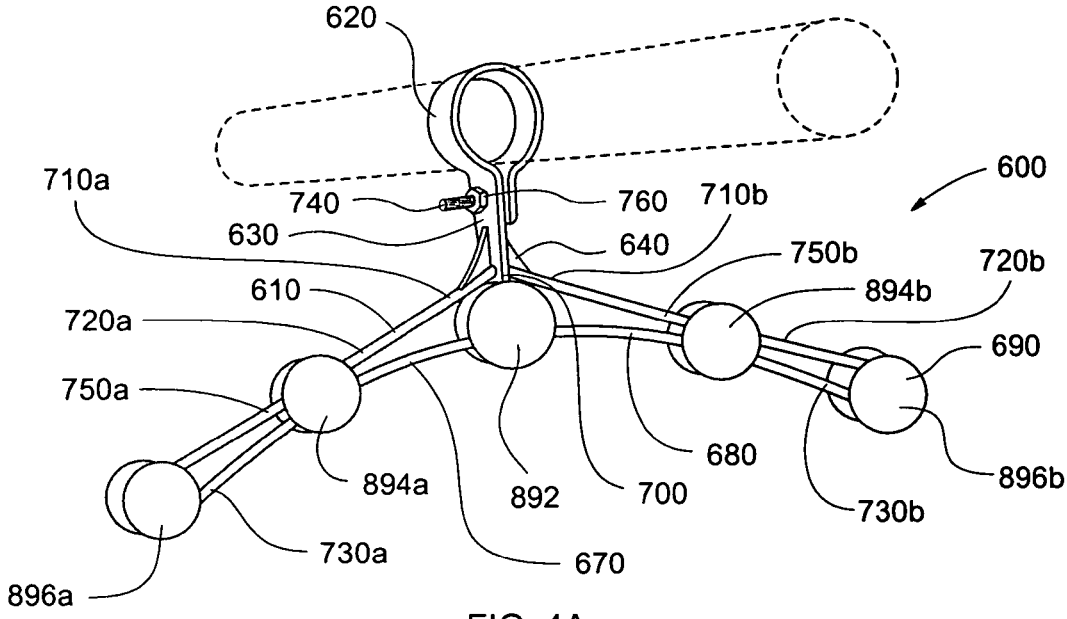

FIG. 4A is a perspective view according to an alternate embodiment of the present invention.

Figure 4B:
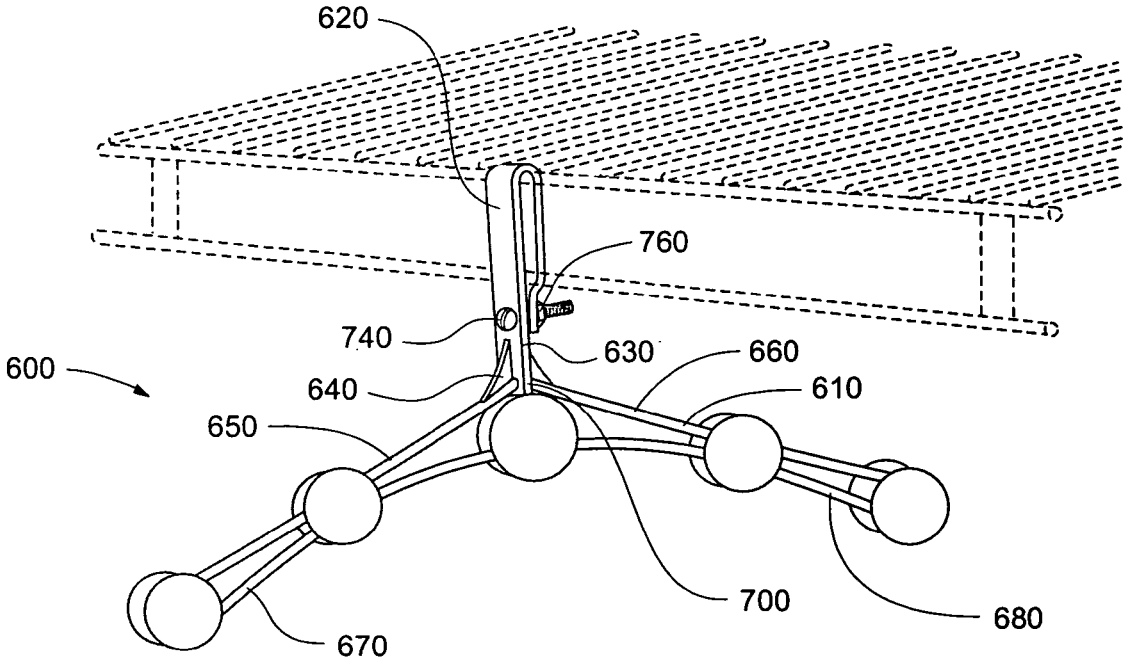

FIG. 4B is a perspective view according to an alternate embodiment of the present invention.

DETAILED DESCRIPTION OF THE PREFERRED AND ALTERNATIVE EMBODIMENTS

In describing the preferred and selected alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1A and 1B, apparatus 10 is preferably formed as an 'S'-shaped hook having body portion 20 preferably having first end 30 with hook portion 40 formed therewith, where hook portion 40 is preferably shaped to hang over a horizontal pole or rod. Hook portion 40 is preferably flattened to cause apparatus 10 to hang facing forward. Shaped portion 80 preferably causes apparatus 10 to hang facing forward on the small rod that is integral with modern wire closet shelving. Preferably located at second end 50 is ball 60. Ball 60 is preferably at least approximately two inches in diameter. Diameter of ball 60 is preferably strategically selected to eliminate or substantially minimize distortion of materials placed over ball 60, in particular, knit clothing.

Preferably located on exterior 70 of ball 60 is a non-slip surface similar to, for exemplary purposes only, 100 grit or coarser sandpaper, or alternately, a frictional elastomeric surface. Preferably the entire surface of ball 60 is non-slip to present the maximum such surface for contact with the garment hung thereon to facilitate retention of the garment.

Ball 60 is preferably joined to second end 50 of body portion 20 at an angle of approximately forty-five degrees from the vertical, which facilitates balance and unhindered contact of the garment with a maximum surface area of ball 60 for best retention.

Apparatus 10 is preferably manufactured and/or integrally formed as a single unit or, alternatively, in components that are subsequently assembled. Apparatus 10, or the components to assemble it, are preferably fabricated by injection molding; however, any suitable process known within the art may be utilized, such as, for exemplary purposes only, casting, rolling, turning, machining, bending, or other molding processes. Apparatus 10 is preferably fabricated from plastic, or alternatively may be fabricated of rubber, wood, metal, or a combination of rubber, wood, metal and/or plastic.

Referring now to FIG. 2, illustrated in an alternate embodiment is apparatus 200, wherein apparatus 200 comprises multiple units of basic embodiment apparatus 10, linked together rigidly or flexibly via connecting rod 250, so that a plurality of clothes may be hung thereon. Apparatus 200 possesses units 10*a*, 10*b*, 10*c* and 10*d*, although any number of units could be utilized. Unit 10*a* has 'S'-shaped body portion 210*a*, upper hook end 240*a* and ball end 220*a*. Unit 10*b* has 'S'-shaped body portion 210*b*, upper hook end 240*b* and ball end 220*b*. Unit 10*c* has 'S'-shaped body portion 210*c*, upper hook end 240*c* and ball end 220*c*. Unit 10*d* has 'S'-shaped body portion 210*d*, upper hook end 240*d*, and ball end 220*d*. Apparatus 200 may be constructed having any number of units suitable for the hanging space available. In an alternative to this embodiment, apparatus 200 may be made of multiple component sections, such as 220*b*/210*b*, and 220*c*/210*c*, that may be snapped together, thus allowing the user to construct apparatus 200 of desired length.

Turning now to FIG. 3A, apparatus 300 is a multiple unit garment hanger having base frame 310 securable to a wall, door, or other suitable surface via suitable fasteners inserted through first hole 320 and second hole 330. It will be recognized by those skilled in the art that various fastening devices may be used, with or without utilizing first hole 320 and second hole 330.

Arranged on base frame 310 are upper hanger balls 340*a*, 340*b*, 340*c*, 340*d* and 340*e* and lower hanger balls 350*a*, 350*b*, 350*c*, 350*d* and 350*e*, wherein upper hanger balls 340*a*, 340*b*, 340*c*, 340*d* and 340*e* extend outward from base frame 310 a greater distance than lower hanger balls 350*a*, 350*b*, 350*c*, 350*d* and 350*e*. It has been found by the inventor that upper hanger balls 340*a*, 340*b*, 340*c*, 340*d* and 340*e* best perform when they extend outward a distance approximately equal to their diameter beyond lower hanger balls 350*a*, 350*b*, 350*c*, 350*d* and 350*e*.

Upper hanger balls 340*a*, 340*b*, 340*c*, 340*d* and 340*e* and lower hanger balls 350*a*, 350*b*, 350*c*, 350*d* and 350*e* are supported on upper pegs 360*a*, 360*b*, 360*c*, 360*d* and 360*e*, and lower pegs 370*a*, 370*b*, 370*c*, 370*d* and 370*e*, respectively.

FIG. 3B depicts a device similar in part to FIG. 3A but comprised of a single lower ball/upper ball unit 400. Unit 400 has base frame 410 with holes 420 and 430 therein for securing unit 400 to a wall, door, or other suitable surface. Located on base frame 410 are extension pegs 460 and 470 having upper ball 440 and lower ball 450, respectively, attached thereto. Upper ball 440 extends outward a distance approximately equal to its diameter beyond lower ball 450.

FIG. 3C depicts the general profile of the upper balls 340*a-e* and lower balls 350*a-e* of multiple unit apparatus 300 shown in FIG. 3A, and upper ball 440 and lower ball 450 of single unit 400 shown in FIG. 3B.

Referring now to FIGS. 4A and 4B, an alternate embodiment 600 of the present invention is shown attached to a horizontal pole or rod, and to a wire closet shelf rack, respectively. Apparatus 600 is comprised of hanger frame 610, hanger loop support 620, neck 630, fillets 640 and balls 690. Fillets 640 serve to strengthen and align apparatus 600.

Hanger frame 610 is comprised of first upper rod 650, second upper rod 660, first lower rod 670, and second lower rod 680, wherein first upper rod 650 and first lower rod 670 form hanger extension 720*a*, and second upper rod 660 and second lower rod 680 form hanger extension 720*b*.

Balls 690 are fixably attached via a suitable means, such as, for exemplary purposes only, by glue, to hanger frame 610 in pairs, located proximate one another on opposite sides of hanger frame 610. First set of balls 892 is carried proximate first ends 710*a* and 710*b* of hanger extensions 720*a* and 720*b*, respectively, and proximate base 700 of neck 630; second sets of balls 894*a* and 894*b* are carried proximate leg centers 750*a* and 750*b*, respectively, of hanger frame 610; and third sets of balls 896*a* and 896*b* are carried proximate second ends 730*a* and 730*b* of hanger extensions 720*a* and 720*b*, respectively.

First lower rod 670 and second lower rod 680 are bent into an arc in order to facilitate securing first set of balls 892 in position below base 700 of neck 630, and further to provide a location for securing and locating second sets of balls 894*a* and 894*b* at midpoints 750*a* and 750*b* of hanger extensions 720*a* and 720*b*, respectively, and third sets of balls 896*a* and 896*b* at second ends 730*a* and 730*b* of hanger extensions 720*a* and 720*b*, respectively.

In operation, apparatus 600 is secured to a horizontal pole or rod by extending loop support 620 over and around the pole or rod and securing apparatus 600 thereon via screw 740 and nut 760 after passage of screw 740 through holes (not shown) in neck 630. Alternately, when utilizing a wire closet shelf, loop support 620 is extended over and around the frame of the closet shelf and apparatus 600 is then secured by passage of screw 740 through holes (not shown) in neck 630 and securing screw 740 via nut 760. Upon securing of apparatus 600, clothing may be placed over individual balls 690 hanger frame 610, wherein apparatus 600 supports the clothing with minimal deformation.

It is contemplated in an alternate embodiment that the individual components of the preferred and/or alternate embodiments of the present invention, namely the 'S'-shaped body and the ball end, could be independently formed and subsequently assembled by any suitable bonding means, such as, for exemplary purposes only, adhesives, epoxies, resins, mecahnical fasteners, or the like.

It is further contemplated in an alternate embodiment that ball 60 could be formed from expanded polystyrene or other expanded rigid plastics and/or elastomeric compounds.

It is envisioned in an alternate embodiment that hook portion 40 could be elliptical or circular in cross-section.

It is envisioned in an alternate embodiment that ball 60 could be of any size, depending on the susceptibility of deformation of the clothing to be retained thereon.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing the steps of the method in a certain order does not constitute any limitation on the order of the steps of the method. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Accordingly, the present invention is not limited to the specific embodiments illustrated herein, but is limited only by the following claims.

What is claimed is:

1. A garment hanger comprising:

at least one generally arcuate member having a first end and at least one second end; and at least one generally spherical-shaped member, wherein said at least one generally spherical-shaped member is carried proximate to said at least one second end of said at least one generally arcuate member and wherein said at least one generally arcuate member comprises an s-shape member with said first end being generally down-turned and at least one second end being generally up-turned; and wherein said hanger is formed from a moldable material.

2. The hanger of claim 1, wherein said first end of said at least one arcuate member defines a generally hook-shape.

3. The hanger of claim 1, wherein said at least one generally spherical-shaped member is a ball at least approximately two inches in diameter.

4. The hanger of claim 1, wherein said at least one generally arcuate member and said at least one generally spherical-shaped member are integrally molded.

5. The hanger of claim 1, further comprising at least one generally non-slip surface carried by said at least one generally spherical-shaped member.

6. The hanger of claim 1, wherein said at least one generally spherical-shaped member comprises a material selected from the group consisting of plastics and elastomers.

7. The hanger of claim 6, wherein said material comprises expanded polystyrene.

8. The hanger of claim 1, wherein said at least one generally spherical-shaped member carries a plurality of surface protrusions.

9. The hanger of claim 1, further comprising means for fixably attaching said at least one generally spherical-shaped member to said at least one generally arcuate member.

10. The hanger of claim 2, wherein said generally hook shape of said first end of said at least one generally arcuate member comprises a section having substantially flat surfaces defining at least a portion of said hook shape.

11. A method of hanging an object comprising the steps of:

a) obtaining an arcuate hanger having a first end, a second end and a ball-shaped support carried at said first end thereof;

b) hanging said second end of said arcuate hanger on an external support; and c) positioning a garment over and substantially covering the surface of said ball-shaped support for retention thereby.

12. The method of claim 11, wherein said second end of said arcuate hanger comprises an indent medially disposed therein, said indent having a radius of curvature smaller than a radius or curvature of said second end.

13. The method of claim 11, wherein said ball-shaped support has a non-slip surface thereon.

14. A clothes hanging apparatus comprising:

a plurality of hanging arms, each comprising a ball end, an arcuate shaft and a hanging end, wherein each of said plurality of hanging arms is connected to at least one adjacent one of said plurality of hanging arms by an integrally formed connecting rod.

15. The clothes hanging apparatus of claim 14, wherein each said connecting rod is fixedly disposed generally perpendicular to a longitudinal axis of said arcuate shaft.

16. A garment hanging device comprising:

a generally planar support frame;

plurality of extension arms, each having a first end and a second end, wherein said first end is secured to said support frame;

at least one ball attached to said second end; and wherein said plurality of extension arms comprises at least one upper extension arm and at least one lower extension arm.

17. The garment hanger of claim 16, wherein said at least one ball comprises at least one upper ball attached to said at least one upper extension arm and at least one lower ball attached to said at least one lower extension arm, wherein said at least one upper extension arm and said lower extension arm have at least one of different lengths and different angular orientation with respect to said generally planar support frame.

18. The garment hanging device of claim 17, wherein said support frame is secured to a surface and said at least one upper ball extends a distance beyond a distal surface of said at least one lower ball in a direction away from the surface, wherein said distance is approximately equal to a diameter of said at least one upper ball.

19. The garment hanger of claim 16, further comprising at least one ball attached proximate said first end and at least one ball attached between said first end and said second end approximately midway therebetween.

* * * * *